US009847052B2

(12) United States Patent
Zeng et al.

(10) Patent No.: US 9,847,052 B2
(45) Date of Patent: Dec. 19, 2017

(54) DRIVE SYSTEM OF AMOLED DISPLAY AND DRIVE METHOD

(71) Applicant: Shenzhen China Star Optoelectronics Technology Co., Ltd., Shenzhen (CN)

(72) Inventors: Yuchao Zeng, Shenzhen (CN); Jing Xu, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 154 days.

(21) Appl. No.: 14/890,910

(22) PCT Filed: Oct. 26, 2015

(86) PCT No.: PCT/CN2015/092794
§ 371 (c)(1),
(2) Date: Nov. 13, 2015

(87) PCT Pub. No.: WO2017/063224
PCT Pub. Date: Apr. 20, 2017

(65) Prior Publication Data

US 2017/0186357 A1 Jun. 29, 2017

(30) Foreign Application Priority Data

Oct. 12, 2015 (CN) ..... 2015 1 0658764

(51) Int. Cl.
*G09G 3/20* (2006.01)
*G09G 3/3225* (2016.01)

(52) U.S. Cl.
CPC ..... *G09G 3/2018* (2013.01); *G09G 3/3225* (2013.01); *G09G 2320/0653* (2013.01); *G09G 2320/103* (2013.01); *G09G 2340/16* (2013.01)

(58) Field of Classification Search
CPC ..... G09G 3/2018; G09G 3/3225; G09G 2320/0653; G09G 2320/103; G09G 2340/16
See application file for complete search history.

(56) References Cited

U.S. PATENT DOCUMENTS

2006/0209095 A1* 9/2006 Hsu ..... G09G 3/3611 345/690
2008/0284768 A1* 11/2008 Yoshida ..... G09G 3/2022 345/208

(Continued)

*Primary Examiner* — Dmitriy Bolotin
(74) *Attorney, Agent, or Firm* — Leong C. Lei

(57) ABSTRACT

The present invention provides a drive system of an AMOLED display and a method. The comparison module (4) is used to compare the first frame of image and a second frame of image in the two adjacent frames of image to be similar or not, and to determine that the second frame of image is a dynamic image or a static image, and to output time count (cnt). The gray scale control module (5) controls output gray scales of corresponding pixels in the second frame of image according the time count (cnt) and the gray scales of respective pixels in the first frame of image: when the second frame of image is the dynamic image, the gray scale control module (5) controls the output gray scales of corresponding pixels in the second frame of image remain to be original gray scales; when the second frame of image is the static image, the gray scale control module (5) controls the output gray scales of corresponding pixels in the second frame of image gradually decrease along with increase of the time count (cnt) in a specific time counting duration, to make a display brightness of the static image slowly decrease. The display effect is not influenced and the lifetime of the AMOLED display is also raised.

10 Claims, 4 Drawing Sheets

(56) References Cited

U.S. PATENT DOCUMENTS

| | | | | |
|---|---|---|---|---|
| 2008/0309683 | A1* | 12/2008 | Kim | G09G 3/2092 345/690 |
| 2010/0060554 | A1* | 3/2010 | Koh | G09G 3/3225 345/77 |
| 2010/0123648 | A1* | 5/2010 | Miller | G09G 3/3208 345/76 |
| 2015/0035875 | A1* | 2/2015 | Jeon | G09G 5/10 345/691 |

* cited by examiner

DRIVE SYSTEM OF AMOLED DISPLAY AND DRIVE METHOD

FIELD OF THE INVENTION

The present invention relates to a display technology field, and more particularly to a drive system of an AMOLED display and a drive method.

BACKGROUND OF THE INVENTION

The Organic Light Emitting Display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED can be categorized into two major types according to the driving methods, which are the Passive Matrix OLED (PMOLED) and the Active Matrix OLED (AMOLED), i.e. two types of the direct addressing and the Thin Film Transistor (TFT) matrix addressing. The AMOLED display comprises pixels arranged in array and belongs to active display type, which has high lighting efficiency and is generally utilized for the large scale display devices of high resolution.

AMOLED display is driven with electrical current, and the pixel structure generally comprises two transistors, a storage capacitor and an organic light emitting diode. The organic light emitting diode is a current driving element. When the electrical current flows through the organic light emitting diode, the organic light emitting diode emits light, and the brightnesses thereof various levels are generated according to the different currents flowing through.

The organic light emitting diode generally comprises an anode, a Hole Injection Layer, a Hole Transporting Layer, an emitting material layer, an Electron Transport Layer, an Electron Injection Layer and a cathode. The higher the display brightness of the organic light emitting diode, the decay of materials of the respective layers inside is more serious. Therefore, to reduce the display brightness of the image of the AMOLED display can extend the lifetime of the AMOLED display. As shown in FIG. 1, the method of extending lifetime of the AMOLED display according to prior art is to reduce the entire brightness of the display image. In FIG. 1, the straight line y10 represents the original display brightness of the image shown by the AMOLED display, and the straight line y20 represents the display brightness after the brightness of the image shown by the AMOLED display is reduced. Such operation can extend the lifetime of the AMOLED display, but the entire brightness is reduced, and the display effect of the AMOLED display is influenced.

SUMMARY OF THE INVENTION

An objective of the present invention is to provide a drive system of an AMOLED display, capable of reducing the display brightness and power consumption of the static image to raise the lifetime of the AMOLED display under the premise of not influencing the display effect.

Another objective of the present invention is to provide a drive method of an AMOLED display, capable of reducing the display brightness and power consumption of the static image to raise the lifetime of the AMOLED display under the premise of not influencing the display effect.

For realizing the aforesaid objectives, the present invention provides a drive system of an AMOLED display, comprising:

a data input module, employed for inputting display data of two adjacent frames of image;

a storage module, electrically coupled to the data input module, and employed for storing the display data of a first frame of image in the two adjacent frames of image;

a first output module, electrically coupled to the storage image, and employed for directly outputting the display data of the first frame of image in the two adjacent frames of image;

a comparison module, electrically coupled to the data input module and the storage module, and employed for comparing the first frame of image and a second frame of image in the two adjacent frames of image to be similar or not, and determining that the second frame of image is a dynamic image or a static image relative to the first frame of image and outputting a time count;

a gray scale control module, electrically coupled to the comparison module and the storage module, and employed for controlling output gray scales of corresponding pixels in the second frame of image according the time count and the gray scales of respective pixels in the first frame of image; when the second frame of image is the dynamic image relative to the first frame of image, the gray scale control module controls the output gray scales of corresponding pixels in the second frame of image remain to be original gray scales; when the second frame of image is the static image relative to the first frame of image, the gray scale control module controls the output gray scales of corresponding pixels in the second frame of image gradually decrease along with increase of the time count in a specific time counting duration, to make a display brightness of the static image slowly decrease;

and a second output module, electrically coupled to the gray scale control module and employed for outputting the display data of the second frame of image after process of the gray scale control module.

The display data of the two adjacent frames of image which are successively inputted by the data input module is frequency doubled.

The gray scale control module comprises a pixel gray scale look up table inside, and the pixel gray scale look up table corresponds to a function f (cnt, gray) that the time count and the gray scales of respective pixels in the first frame of image, wherein cnt represents the time count and gray represents the gray scales of respective pixels in the first frame of image; the gray scale control module controls the output gray scales of corresponding pixels in the second frame of image by looking up the pixel gray scale look up table.

When the second frame of image is the dynamic image relative to the first frame of image, the time count outputted by the comparison module is always 0, and the output gray scales of corresponding pixels in the second frame of image that the gray scale control module looks up from the pixel gray scale look up table remain to be the original gray scales.

When the second frame of image is the static image relative to the first frame of image, the time count cnt outputted by the comparison module uses 0 to be an initial value, and iterative accumulation is proceeded with increase value of 1, with the cnt, the output gray scales of corresponding pixels in the second frame of image that the gray scale control module looks up from the pixel gray scale look up table gradually decrease along with increase of the time count in the specific time counting duration.

The present invention further provides a drive method of an AMOLED display, comprising steps of:

step 1, providing a drive system of the AMOLED display;

the drive system of the AMOLED display comprises a data input module, a storage module electrically coupled to the data input module, a first output module electrically coupled to the storage module, a comparison module electrically coupled to the data input module and the storage module, a gray scale control module electrically coupled to the comparison module and the storage module, and a second output module electrically coupled to the gray scale control module;

step 2, the data input module inputs display data of two adjacent frames of image, and the display data of the first frame of image in the two adjacent frames of image is directly outputted by the first output module and stored in the storage module, and the display data of the second frame of image in the two adjacent frames of image enters the comparison module;

step 3, the comparison module compares the first frame of image and a second frame of image in the two adjacent frames of image to be similar or not, and determines that the second frame of image is a dynamic image or a static image relative to the first frame of image and outputs a time count;

step 4, the gray scale control module controls output gray scales of corresponding pixels in the second frame of image according the time count and the gray scales of respective pixels in the first frame of image; when the second frame of image is the dynamic image relative to the first frame of image, the gray scale control module controls the output gray scales of corresponding pixels in the second frame of image remain to be original gray scales; when the second frame of image is the static image relative to the first frame of image, the gray scale control module controls the output gray scales of corresponding pixels in the second frame of image gradually decrease along with increase of the time count in a specific time counting duration;

step 5, the second output module outputs the display data of the second frame of image after process of the gray scale control module.

In the step 2, the display data of the two adjacent frames of image which are successively inputted by the data input module is frequency doubled.

The gray scale control module comprises a pixel gray scale look up table inside, and the pixel gray scale look up table corresponds to a function f (cnt, gray) that the time count and the gray scales of respective pixels in the first frame of image, wherein cnt represents the time count and gray represents the gray scales of respective pixels in the first frame of image;

in the step 4, the gray scale control module controls the output gray scales of corresponding pixels in the second frame of image by looking up the pixel gray scale look up table.

When the second frame of image is determined to be the dynamic image relative to the first frame of image in the step 3, the time count outputted by the comparison module is always 0, and the output gray scales of corresponding pixels in the second frame of image that the gray scale control module looks up from the pixel gray scale look up table in the step 4 remain to be the original gray scales.

When the second frame of image is determined to be the static image relative to the first frame of image in the step 3, the time count outputted by the comparison module uses 0 to be an initial value, and iterative accumulation is proceeded with increase value of 1, and the output gray scales of corresponding pixels in the second frame of image that the gray scale control module looks up from the pixel gray scale look up table gradually in the step 4 decrease along with increase of the time count in the specific time counting duration.

The present invention further provides a drive system of an AMOLED display, comprising:

a data input module, employed for inputting display data of two adjacent frames of image;

a storage module, electrically coupled to the data input module, and employed for storing the display data of a first frame of image in the two adjacent frames of image;

a first output module, electrically coupled to the storage image, and employed for directly outputting the display data of the first frame of image in the two adjacent frames of image;

a comparison module, electrically coupled to the data input module and the storage module, and employed for comparing the first frame of image and a second frame of image in the two adjacent frames of image to be similar or not, and determining that the second frame of image is a dynamic image or a static image relative to the first frame of image and outputting a time count;

a gray scale control module, electrically coupled to the comparison module and the storage module, and employed for controlling output gray scales of corresponding pixels in the second frame of image according the time count and the gray scales of respective pixels in the first frame of image; when the second frame of image is the dynamic image relative to the first frame of image, the gray scale control module controls the output gray scales of corresponding pixels in the second frame of image remain to be original gray scales; when the second frame of image is the static image relative to the first frame of image, the gray scale control module controls the output gray scales of corresponding pixels in the second frame of image gradually decrease along with increase of the time count in a specific time counting duration, to make a display brightness of the static image slowly decrease;

and a second output module, electrically coupled to the gray scale control module and employed for outputting the display data of the second frame of image after process of the gray scale control module;

wherein the display data of the two adjacent frames of image which are successively inputted by the data input module is frequency doubled;

wherein the gray scale control module comprises a pixel gray scale look up table inside, and the pixel gray scale look up table corresponds to a function f (cnt, gray) that the time count and the gray scales of respective pixels in the first frame of image, wherein cnt represents the time count and gray represents the gray scales of respective pixels in the first frame of image; the gray scale control module controls the output gray scales of corresponding pixels in the second frame of image by looking up the pixel gray scale look up table;

wherein when the second frame of image is the dynamic image relative to the first frame of image, the time count outputted by the comparison module is always 0, and the output gray scales of corresponding pixels in the second frame of image that the gray scale control module looks up from the pixel gray scale look up table remain to be the original gray scales.

The benefits of the present invention are: the present invention provides a drive system of an AMOLED display and a method. The comparison module is used to compare the first frame of image and a second frame of image in the two adjacent frames of image to be similar or not, and to determine that the second frame of image is a dynamic image or a static image relative to the first frame of image, and to output time count. The gray scale control module controls output gray scales of corresponding pixels in the second frame of image according the time count and the gray scales of respective pixels in the first frame of image: when the second frame of image is the dynamic image relative to the first frame of image, the gray scale control module controls the output gray scales of corresponding pixels in the second frame of image remain to be original gray scales; when the second frame of image is the static image relative to the first frame of image, the gray scale control module controls the output gray scales of corresponding pixels in the second frame of image gradually decrease along with increase of the time count in a specific time counting duration, to make a display brightness of the static image slowly decrease with a speed that is not aware by human eyes. It is achieved that the display brightness and power consumption of the static image is reduced to raise the lifetime of the AMOLED display under the premise of not influencing the display effect.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
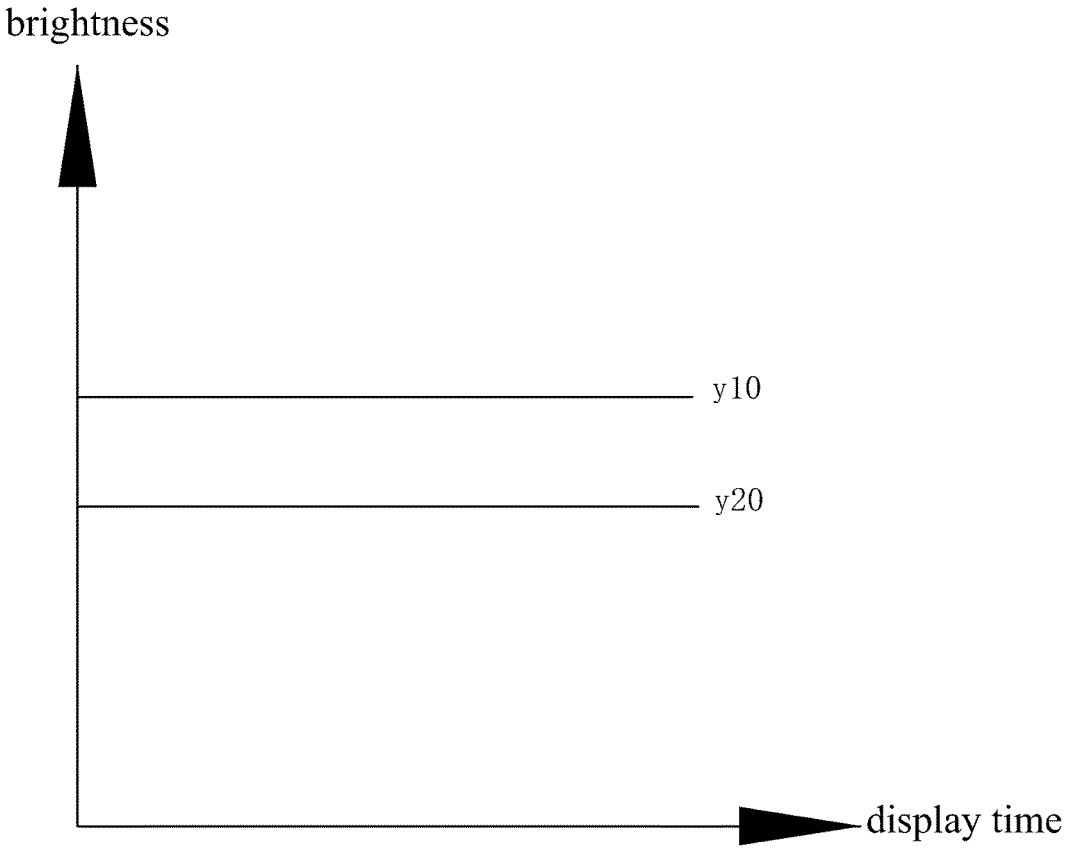
FIG. 1 is a diagram of extending the lifetime of an AMOLED display by reducing the brightness of the display image according to prior art.
Figure 2:
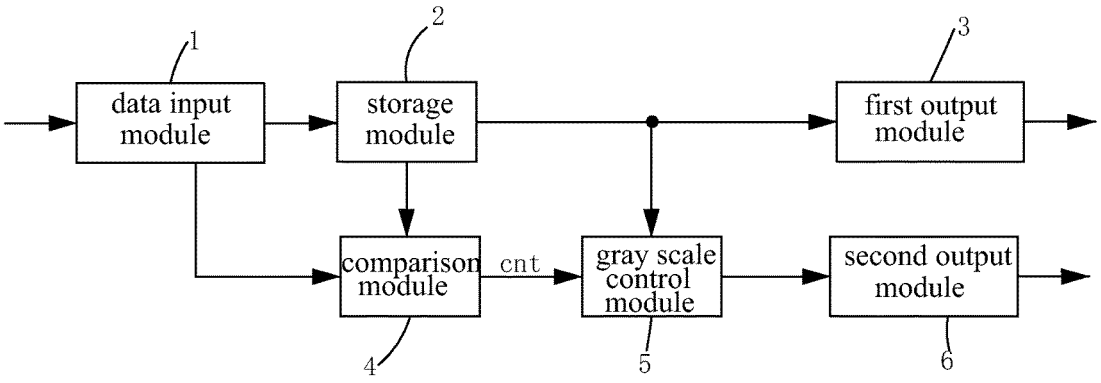
FIG. 2 is a structure block diagram of a drive system of an AMOLED display according to the present invention.

Please refer to FIG. 2. The present invention provides a drive system of an AMOLED display, comprising: a data input module 1, a storage module 2 electrically coupled to the data input module 1, a first output module 3 electrically coupled to the storage module 2, a comparison module 4 electrically coupled to the data input module 1 and the storage module 2, a gray scale control module 5 electrically coupled to the comparison module 4 and the storage module 2, and a second output module 6 electrically coupled to the gray scale control module 5.

The data input module 1 is employed for inputting display data of two adjacent frames of image. Significantly, the display data of the two adjacent frames of image which are successively inputted by the data input module 1 is frequency doubled. That is to say that the driving frequency of the AMOLED display is raised to twice of the original driving frequency. Thus, two adjacent frames of image can be shown in the original duration for showing merely one frame of image.

The storage module 2 is employed for storing the display data of a first frame of image in the two adjacent frames of image.

The first output module 3 is employed for directly outputting the display data of the first frame of image in the two adjacent frames of image.

The comparison module 4 compares the first frame of image and a second frame of image in the two adjacent frames of image to be similar or not by comparing the display data of respective pixels in the first frame of image and corresponding pixels in the second frame of image in the two adjacent frames of image, and determines that the second frame of image is a dynamic image or a static image relative to the first frame of image and outputs a time count cnt. Specifically, if the first frame of image and the second frame of image are not similar, the second frame of image is determined to be a dynamic image relative to the first frame of image. Under such circumstance, the time count cnt outputted by the comparison module 4 is always 0; if the first frame of image and the second frame of image are similar, the second frame of image is determined to be a static image relative to the first frame of image. Under such circumstance, the time count cnt outputted by the comparison module 4 uses 0 to be an initial value, and iterative accumulation is proceeded with increase value of 1, i.e. cnt=cnt+1.

Figure 5:
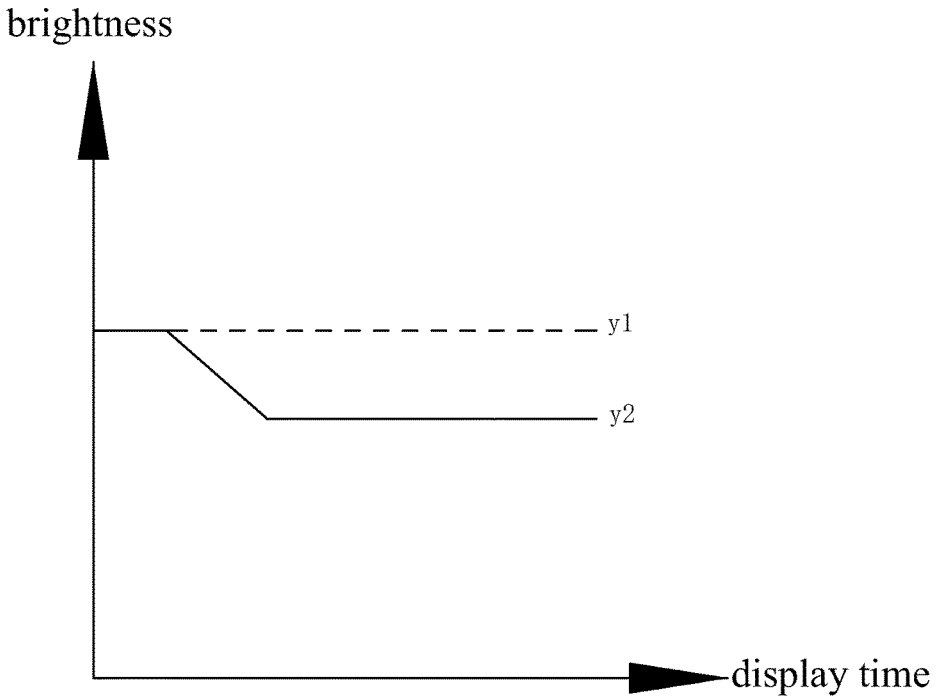
FIG. 5 is a diagram of reducing the display brightness of an static image with the drive system of the AMOLED display according to the present invention.

The gray scale control module 5 is employed for controlling output gray scales of corresponding pixels in the second frame of image according the time count cnt and the gray scales of respective pixels in the first frame of image; when the second frame of image is the dynamic image relative to the first frame of image, the gray scale control module 5 controls the output gray scales of corresponding pixels in the second frame of image remain to be original gray scales; when the second frame of image is the static image relative to the first frame of image, the gray scale control module 5 controls the output gray scales of corresponding pixels in the second frame of image gradually decreased along with increase of the time count cnt in a specific time counting duration, to make a display brightness of the static image slowly decrease with a speed that is not aware by human eyes as shown in FIG. 5 (y1 represents the original display brightness of the static image, and y2 represents the display brightness of the static image reduced by the drive system of the present invention). Under the premise of not influencing the display effect, the display brightness and power consumption of the static image are reduced to extend the lifetime of the AMOLED display.

The second output module 6 is employed for outputting the display data of the second frame of image after process of the gray scale control module 5.

Significantly, the gray scale control module 5 comprises a pixel gray scale look up table inside, and the pixel gray scale look up table corresponds to a function f (cnt, gray) that the time count cnt and the gray scales of respective pixels in the first frame of image, wherein cnt represents the time count and gray represents the gray scales of respective pixels in the first frame of image. The pixel gray scale look up table can be set according to image display properties, such as display brightness, Gamma curve and contrast.

The gray scale control module 5 controls the output gray scales of corresponding pixels in the second frame of image by looking up the pixel gray scale look up table:

when the second frame of image is the dynamic image relative to the first frame of image, the time count cnt outputted by the comparison module 4 is always 0, and the output gray scales of corresponding pixels in the second frame of image that the gray scale control module 5 looks up from the pixel gray scale look up table remain to be the original gray scales. Namely, the display brightnesses of corresponding pixels in the second frame of image remain to be original display brightnesses to ensure the display effect of the dynamic image.

Figure 3:
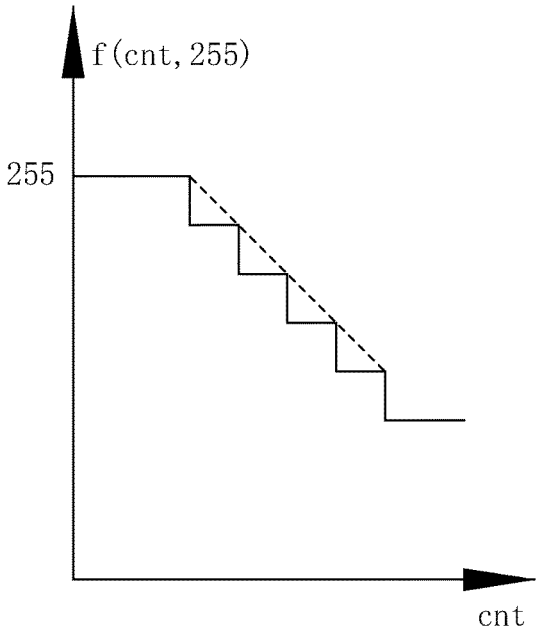
FIG. 3, FIG. 4 are two illustrations of pixel gray scale look up table in the drive system of the AMOLED display according to the present invention.
Figure 4:
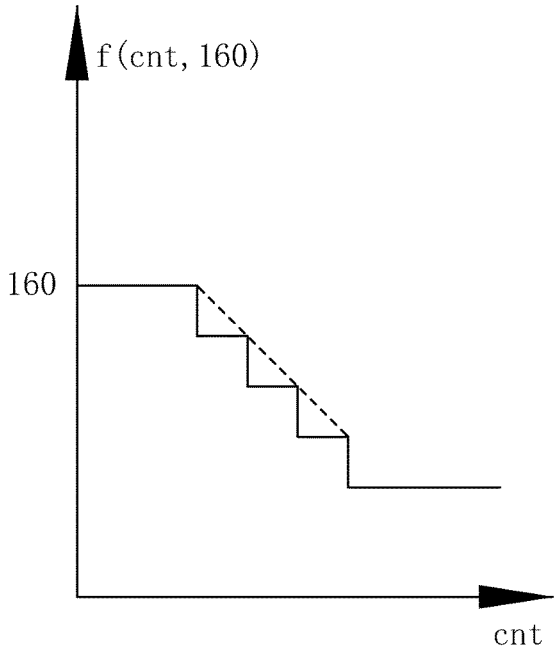

When the second frame of image is the static image relative to the first frame of image, the time count cnt outputted by the comparison module 4 uses 0 to be an initial value, and iterative accumulation is proceeded with increase value of 1, i.e. cnt=cnt+1. the output gray scales of corresponding pixels in the second frame of image that the gray scale control module 5 looks up from the pixel gray scale look up table gradually decrease along with increase of the time count in the specific time counting duration. After the time count cnt increases and exceeds the specific time counting duration, the output gray scales of corresponding pixels in the second frame of image no longer decreases along with the increase of the time count cnt but remain to be the minimum output gray scale decreased in the specific time counting duration. For example, as shown in FIG. 3, if the gray scale of some pixel in the first frame of image is 255, the output gray scale of the corresponding pixel in the second frame of image can be looked up in the gray scale look up table to be f(cnt, 255), and the output gray scale in the specific time counting duration gradually decreases from 255 along with the increase of the time count cnt; as shown in FIG. 4, if the gray scale of some pixel in the first frame of image is 160, the output gray scale of the corresponding pixel in the second frame of image can be looked up in the gray scale look up table to be f(cnt, 160), and the output gray scale in the specific time counting duration gradually decreases from 160 along with the increase of the time count cnt.

Figure 6:
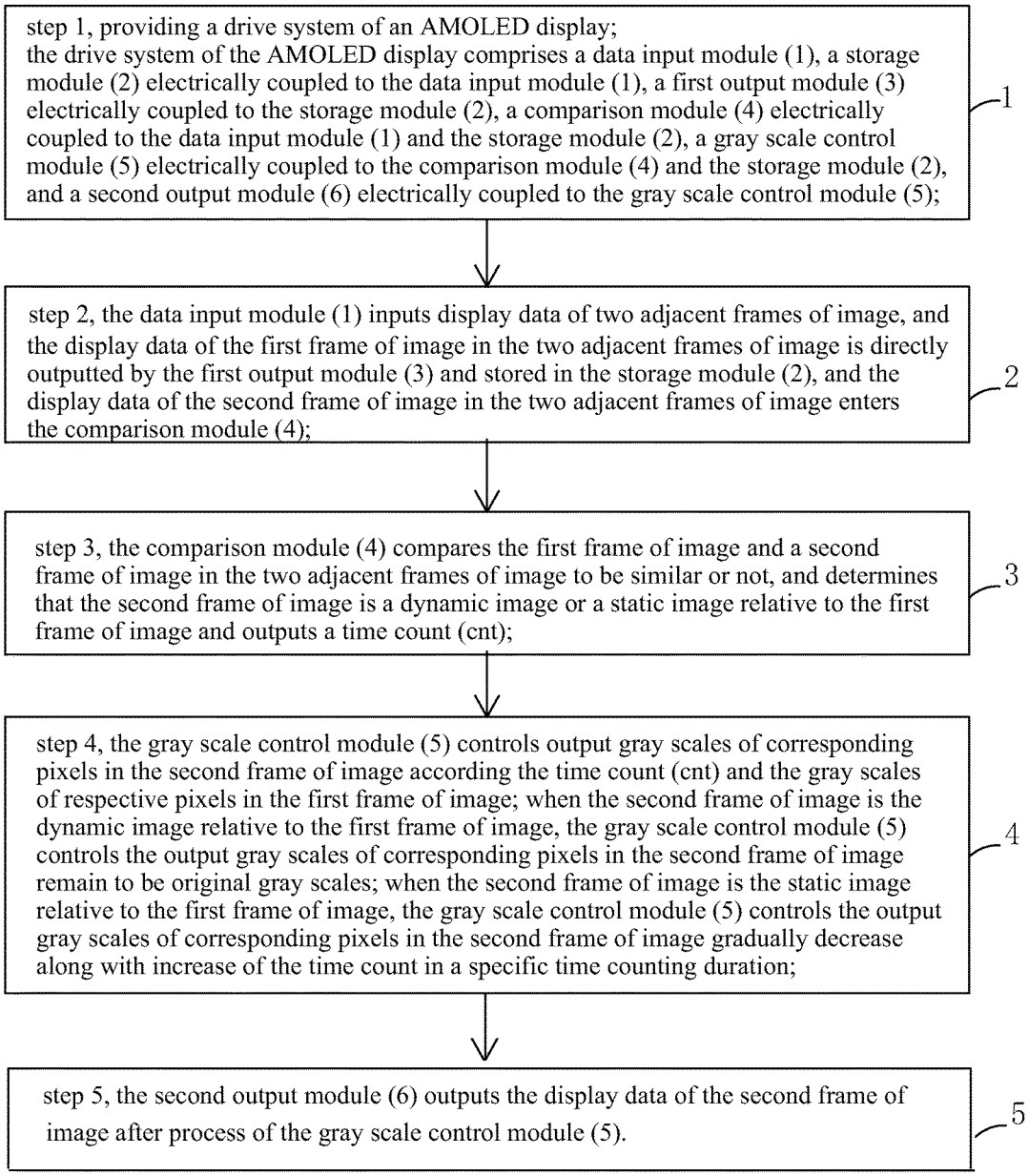
FIG. 6 is a flowchart of a drive method of an AMOLED display according to the present invention.

Please refer to FIG. 6. On the basis of the aforesaid drive system of the AMOLED display, the present invention further provides a drive method of an AMOLED display, comprising steps of:

step 1, a drive system of an AMOLED display shown in FIG. 2 is provided, and the drive system of the AMOLED display comprises a data input module 1, a storage module 2 electrically coupled to the data input module 1, a first output module 3 electrically coupled to the storage module 2, a comparison module 4 electrically coupled to the data input module 1 and the storage module 2, a gray scale control module 5 electrically coupled to the comparison module 4 and the storage module 2, and a second output module 6 electrically coupled to the gray scale control module 5.

step 2, the data input module 1 inputs display data of two adjacent frames of image, and the display data of the first frame of image in the two adjacent frames of image is directly outputted by the first output module 3 and stored in the storage module 2, and the display data of the second frame of image in the two adjacent frames of image enters the comparison module 4.

Significantly, the display data of the two adjacent frames of image which are successively inputted by the data input module 1 is frequency doubled.

step 3, the comparison module 4 compares the first frame of image and a second frame of image in the two adjacent frames of image to be similar or not by comparing the display data of respective pixels in the first frame of image and corresponding pixels in the second frame of image in the two adjacent frames of image, and determines that the second frame of image is a dynamic image or a static image relative to the first frame of image and outputs a time count cnt.

Specifically, if the first frame of image and the second frame of image are not similar, the second frame of image is determined to be a dynamic image relative to the first frame of image. Under such circumstance, the time count cnt outputted by the comparison module 4 is always 0; if the first frame of image and the second frame of image are similar, the second frame of image is determined to be a static image relative to the first frame of image. Under such circumstance, the time count cnt outputted by the comparison module 4 uses 0 to be an initial value, and iterative accumulation is proceeded with increase value of 1, i.e. cnt=cnt+1.

step 4, the gray scale control module 5 controls output gray scales of corresponding pixels in the second frame of image according the time count cnt and the gray scales of respective pixels in the first frame of image.

When the second frame of image is the dynamic image relative to the first frame of image, the gray scale control module 5 controls the output gray scales of corresponding pixels in the second frame of image remain to be original gray scales; when the second frame of image is the static image relative to the first frame of image, the gray scale control module 5 controls the output gray scales of corresponding pixels in the second frame of image gradually decreased along with increase of the time count cnt in a specific time counting duration, to make a display brightness of the static image slowly decrease with a speed that is not aware by human eyes as shown in FIG. 5 (y1 represents the original display brightness of the static image, and y2 represents the display brightness of the static image reduced by the drive system of the present invention). Under the premise of not influencing the display effect, the display brightness and power consumption of the static image are reduced to extend the lifetime of the AMOLED display.

Specifically, the gray scale control module 5 comprises a pixel gray scale look up table inside, and the pixel gray scale look up table corresponds to a function f (cnt, gray) that the time count cnt and the gray scales of respective pixels in the first frame of image, wherein cnt represents the time count and gray represents the gray scales of respective pixels in the first frame of image. The pixel gray scale look up table can be set according to image display properties, such as display brightness, Gamma curve and contrast.

The gray scale control module 5 controls the output gray scales of corresponding pixels in the second frame of image by looking up the pixel gray scale look up table:

when the second frame of image is the dynamic image relative to the first frame of image, the time count cnt outputted by the comparison module 4 is always 0, and the output gray scales of corresponding pixels in the second frame of image that the gray scale control module 5 looks up from the pixel gray scale look up table remain to be the original gray scales. Namely, the display brightnesses of corresponding pixels in the second frame of image remain to be original display brightnesses to ensure the display effect of the dynamic image.

When the second frame of image is the static image relative to the first frame of image, the time count cnt outputted by the comparison module 4 uses 0 to be an initial value, and iterative accumulation is proceeded with increase value of 1, i.e. cnt=cnt+1. the output gray scales of corresponding pixels in the second frame of image that the gray scale control module 5 looks up from the pixel gray scale look up table gradually decrease along with increase of the time count in the specific time counting duration. After the time count cnt increases and exceeds the specific time counting duration, the output gray scales of corresponding pixels in the second frame of image no longer decreases along with the increase of the time count cnt but remain to be the minimum output gray scale decreased in the specific time counting duration. For example, as shown in FIG. 3, if the gray scale of some pixel in the first frame of image is 255, the output gray scale of the corresponding pixel in the second frame of image can be looked up in the gray scale look up table to be f(cnt, 255), and the output gray scale in the specific time counting duration gradually decreases from 255 along with the increase of the time count cnt; as shown in FIG. 4, if the gray scale of some pixel in the first frame of image is 160, the output gray scale of the corresponding pixel in the second frame of image can be looked up in the gray scale look up table to be f(cnt, 160), and the output gray scale in the specific time counting duration gradually decreases from 160 along with the increase of the time count cnt.

step 5, the second output module 6 outputs the display data of the second frame of image after process of the gray scale control module 5.

In conclusion, in the drive system of the AMOLED display and the method according to the present invention, the comparison module is used to compare the first frame of image and a second frame of image in the two adjacent frames of image to be similar or not, and to determine that the second frame of image is a dynamic image or a static image relative to the first frame of image, and to output time count. The gray scale control module controls output gray scales of corresponding pixels in the second frame of image according the time count and the gray scales of respective pixels in the first frame of image: when the second frame of image is the dynamic image relative to the first frame of image, the gray scale control module controls the output gray scales of corresponding pixels in the second frame of image remain to be original gray scales; when the second frame of image is the static image relative to the first frame of image, the gray scale control module controls the output gray scales of corresponding pixels in the second frame of image gradually decrease along with increase of the time count in a specific time counting duration, to make a display brightness of the static image slowly decrease with a speed that is not aware by human eyes. It is achieved that the display brightness and power consumption of the static image is reduced to raise the lifetime of the AMOLED display under the premise of not influencing the display effect.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A drive system of an AMOLED display, comprising:

a data input module, employed for inputting display data of two adjacent frames of image;

a storage module, electrically coupled to the data input module, and employed for storing the display data of a first frame of image in the two adjacent frames of image;

a first output module, electrically coupled to the storage module, and employed for directly outputting the display data of the first frame of image in the two adjacent frames of image;

a comparison module, electrically coupled to the data input module and the storage module, and employed for comparing the first frame of image and a second frame of image in the two adjacent frames of image to be similar or not, and determining that the second frame of image is a dynamic image or a static image relative to the first frame of image and outputting a time count;

a gray scale control module, electrically coupled to the comparison module and the storage module, and employed for controlling output gray scales of corresponding pixels in the second frame of image according the time count and the gray scales of respective pixels in the first frame of image; when the second frame of image is the dynamic image relative to the first frame of image, the gray scale control module controls the output gray scales of corresponding pixels in the second frame of image remain to be original gray scales; when the second frame of image is the static image relative to the first frame of image, the gray scale control module controls the output gray scales of corresponding pixels in the second frame of image gradually decrease along with increase of the time count in a specific time counting duration, to make a display brightness of the static image slowly decrease;

and a second output module, electrically coupled to the gray scale control module and employed for outputting the display data of the second frame of image after process of the gray scale control module, wherein the display data of the two adjacent frames of image which are successively inputted by the data input module is frequency doubled to show the two adjacent frames of image in an original duration for showing merely one frame of image.

2. The drive system of the AMOLED display according to claim 1, wherein the gray scale control module comprises a pixel gray scale look up table inside, and the pixel gray scale look up table corresponds to a function f (cnt, gray) that the time count and the gray scales of respective pixels in the first frame of image, wherein cnt represents the time count and gray represents the gray scales of respective pixels in the first frame of image; the gray scale control module controls the output gray scales of corresponding pixels in the second frame of image by looking up the pixel gray scale look up table.

3. The drive system of the AMOLED display according to claim 2, wherein when the second frame of image is the dynamic image relative to the first frame of image, the time count outputted by the comparison module is always 0, and the output gray scales of corresponding pixels in the second frame of image that the gray scale control module looks up from the pixel gray scale look up table remain to be the original gray scales.

4. The drive system of the AMOLED display according to claim 3, wherein when the second frame of image is the static image relative to the first frame of image, the time count outputted by the comparison module uses 0 to be an initial value, and iterative accumulation is proceeded with increase value of 1, the output gray scales of corresponding pixels in the second frame of image that the gray scale control module looks up from the pixel gray scale look up table gradually decrease along with increase of the time count in the specific time counting duration.

5. A drive method of an AMOLED display, comprising steps of:

step 1, providing a drive system of the AMOLED display; the drive system of the AMOLED display comprises a data input module, a storage module electrically coupled to the data input module, a first output module electrically coupled to the storage module, a comparison module electrically coupled to the data input module and the storage module, a gray scale control module electrically coupled to the comparison module and the storage module, and a second output module electrically coupled to the gray scale control module;

step 2, the data input module inputs display data of two adjacent frames of image, and the display data of the first frame of image in the two adjacent frames of image is directly outputted by the first output module and stored in the storage module, and the display data of the second frame of image in the two adjacent frames of image enters the comparison module;

step 3, the comparison module compares the first frame of image and a second frame of image in the two adjacent frames of image to be similar or not, and determines that the second frame of image is a dynamic image or a static image relative to the first frame of image and outputs a time count;

step 4, the gray scale control module controls output gray scales of corresponding pixels in the second frame of image according the time count and the gray scales of respective pixels in the first frame of image; when the second frame of image is the dynamic image relative to the first frame of image, the gray scale control module controls the output gray scales of corresponding pixels in the second frame of image remain to be original gray scales; when the second frame of image is the static image relative to the first frame of image, the gray scale control module controls the output gray scales of corresponding pixels in the second frame of image gradually decrease along with increase of the time count in a specific time counting duration;

step 5, the second output module outputs the display data of the second frame of image after process of the gray scale control module, wherein in the step 2, the display data of the two adjacent frames of image which are successively inputted by the data input module is frequency doubled to show the two adjacent frames of image in an original duration for showing merely one frame of image.

6. The drive method of the AMOLED display according to claim 5, wherein the gray scale control module comprises a pixel gray scale look up table inside, and the pixel gray scale look up table corresponds to a function f (cnt, gray) that the time count and the gray scales of respective pixels in the first frame of image, wherein cnt represents the time count and gray represents the gray scales of respective pixels in the first frame of image;

in the step 4, the gray scale control module controls the output gray scales of corresponding pixels in the second frame of image by looking up the pixel gray scale look up table.

7. The drive method of the AMOLED display according to claim 6, wherein when the second frame of image is determined to be the dynamic image relative to the first frame of image in the step 3, the time count outputted by the comparison module is always 0, and the output gray scales of corresponding pixels in the second frame of image that the gray scale control module looks up from the pixel gray scale look up table in the step 4 remain to be the original gray scales.

8. The drive method of the AMOLED display according to claim 6, wherein when the second frame of image is determined to be the static image relative to the first frame of image in the step 3, the time count outputted by the comparison module uses 0 to be an initial value, and iterative accumulation is proceeded with increase value of 1, and the output gray scales of corresponding pixels in the second frame of image that the gray scale control module looks up from the pixel gray scale look up table gradually in the step 4 decrease along with increase of the time count in the specific time counting duration.

9. A drive system of an AMOLED display, comprising:

a data input module, employed for inputting display data of two adjacent frames of image;

a storage module, electrically coupled to the data input module, and employed for storing the display data of a first frame of image in the two adjacent frames of image;

a first output module, electrically coupled to the storage module, and employed for directly outputting the display data of the first frame of image in the two adjacent frames of image;

a comparison module, electrically coupled to the data input module and the storage module, and employed for comparing the first frame of image and a second frame of image in the two adjacent frames of image to be similar or not, and determining that the second frame of image is a dynamic image or a static image relative to the first frame of image and outputting a time count;

a gray scale control module, electrically coupled to the comparison module and the storage module, and employed for controlling output gray scales of corresponding pixels in the second frame of image according the time count and the gray scales of respective pixels in the first frame of image; when the second frame of image is the dynamic image relative to the first frame of image, the gray scale control module controls the output gray scales of corresponding pixels in the second frame of image remain to be original gray scales; when the second frame of image is the static image relative to the first frame of image, the gray scale control module controls the output gray scales of corresponding pixels in the second frame of image gradually decrease along with increase of the time count in a specific time counting duration, to make a display brightness of the static image slowly decrease;

and a second output module, electrically coupled to the gray scale control module and employed for outputting the display data of the second frame of image after process of the gray scale control module;

wherein the display data of the two adjacent frames of image which are successively inputted by the data input module is frequency doubled to show the two adjacent frames of image in an original duration for showing merely one frame of image;

wherein the gray scale control module comprises a pixel gray scale look up table inside, and the pixel gray scale look up table corresponds to a function f (cnt, gray) that the time count and the gray scales of respective pixels in the first frame of image, wherein cnt represents the time count and gray represents the gray scales of respective pixels in the first frame of image; the gray scale control module controls the output gray scales of corresponding pixels in the second frame of image by looking up the pixel gray scale look up table;

wherein when the second frame of image is the dynamic image relative to the first frame of image, the time count outputted by the comparison module is always 0, and the output gray scales of corresponding pixels in the second frame of image that the gray scale control module looks up from the pixel gray scale look up table remain to be the original gray scales.

10. The drive system of the AMOLED display according to claim 9, wherein when the second frame of image is the static image relative to the first frame of image, the time count outputted by the comparison module uses 0 to be an initial value, and iterative accumulation is proceeded with increase value of 1, the output gray scales of corresponding pixels in the second frame of image that the gray scale control module looks up from the pixel gray scale look up table gradually decrease along with increase of the time count in the specific time counting duration.

* * * * *